US005246345A

United States Patent [19]

Adams, Jr.

[11] Patent Number: 5,246,345

[45] Date of Patent: Sep. 21, 1993

[54] BOAT PROPELLER COVER

[76] Inventor: Michael J. Adams, Jr., 197 Presque Isle Dr., Houma, La. 70363

[21] Appl. No.: 957,664

[22] Filed: Oct. 7, 1992

[51] Int. Cl.[5] ..... B63H 1/14

[52] U.S. Cl. ..... 416/247 A; 416/146 R; 70/232

[58] Field of Search ..... 416/146 R, 247 R, 247 A; 440/71, 113, 900; 150/157; 70/209, 232, 455, 178; 292/307 B

[56] References Cited

U.S. PATENT DOCUMENTS

| | | | |
|---|---|---|---|
| 1,329,913 | 2/1920 | McGuire | 70/209 |
| 2,529,432 | 11/1950 | Tenner | 70/232 |
| 2,822,183 | 2/1958 | Montgomery | 416/247 A |
| 2,949,092 | 8/1960 | Fortune | 416/62 |
| 3,732,033 | 5/1973 | Macchi . | |
| 3,981,165 | 9/1976 | Wersinger . | |
| 3,981,617 | 9/1976 | Milewicz . | |
| 3,982,602 | 9/1976 | Gorman . | |
| 4,257,247 | 3/1981 | Sims . | |
| 4,630,456 | 12/1986 | Nielson, Jr. | 70/178 |
| 4,715,783 | 12/1987 | Wade . | |

FOREIGN PATENT DOCUMENTS

| | | | |
|---|---|---|---|
| 204673 | 12/1983 | Fed. Rep. of Germany | 416/62 |

*Primary Examiner*—Edward K. Look
*Assistant Examiner*—James A. Larson
*Attorney, Agent, or Firm*—Phelps Dunbar

[57] ABSTRACT

A locking boat propeller cover that completely encloses the propeller whereby unauthorized removal of the propeller is prevented, the propeller is protected from damage, and the risk of injury to people coming into contact with the propeller area is reduced.

11 Claims, 2 Drawing Sheets

BOAT PROPELLER COVER

This invention relates to a locking cover for a marine-type propeller to prevent unauthorized removal of the propeller, to protect the propeller from damage, and to protect individuals from injury due to unintended contact with an uncovered propeller.

BACKGROUND OF THE INVENTION

Propellers commonly found on outboard and inboard motors of marine vessels are subject to theft and damage when not in use. Some propellers are made of expensive materials designed to defeat corrosion and are consequently more costly and increasingly subject to theft. New innovative propeller designs also tend to increase cost. Propellers are also exposed to damage when the vessel is being trailered, or is sitting out of the water. Small nicks or blemishes in a propeller can substantially reduce efficiency.

Propellers also present a risk of injury to people when the vessel is out of the water. Children playing in and around boars may be cut by falling on or running into the blades of the propeller. Adults are also at risk as they may come into contact with the propeller in a manner which can cause injury.

Several propeller locking mechanisms are disclosed in the prior art. For example, U.S. Pat. No. 3,732,033 to Macchi discloses a device which prevents access to the nut retaining the propeller. U.S. Pat. No. 4,715,783 to Wade discloses a device which physically prevents removal of the propeller even if the retaining nut is removed. However, the prior art does not disclose a device which both prevents removal of the propeller and encloses the propeller in a cover such that the propeller is protected from damage and theft, and people are protected from injury resulting from unintentional contact with the propeller.

It is the principal object of this invention to provide a boat propeller cover which both prevents theft or damage of the propeller and protects people from injury due to unintentional contact with the propeller. Other objects of this invention include the provision of a boat propeller cover which is adaptable to various propeller sizes, durable, easy to manufacture, inexpensive, and easy to operate.

SUMMARY OF THE INVENTION

The invention comprises a hinged housing in the general form of a truncated cone. The housing is divided into two generally equal portions, connected at one edge by hinge means. Opposite the hinge is a latching mechanism provided with an eyelet designed to accept a standard padlock. The cover is opened and placed around the propeller and then closed and latched. A padlock may then be used to lock the housing portions together. The latching mechanism provides several openings for receiving an eyelet, such that different sizes of propellers may be accommodated by one size housing.

DESCRIPTION OF THE PREFERRED EMBODIMENT

Figure 1:
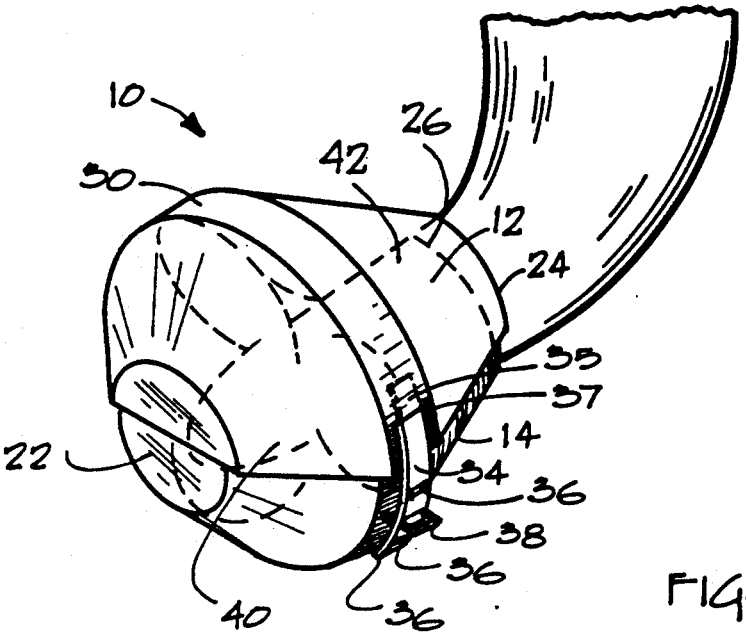
FIG. 1 is a perspective view of a boat propeller cover embodying the invention.

As best seen in FIG. 1, the invention involves a housing 10 divided into two approximately equal halves 12 and 14. The housing 10, when in use, completely encloses a propeller 40. The housing 10 may be any suitable shape, but is shown in this embodiment as generally a truncated cone. The housing 10 includes a flat front surface 22, and a flat rear surface 24. The flat rear surface 24 surrounds an opening 26 which accommodates the propeller shaft 42. The two halves 12 and 14 are flexibly connected with a hinge 32. The hinge 32 is affixed to the inside of the housing 10 to reduce the likelihood that the hinge 32 may be tampered with by someone attempting to steal the propeller 40. The hinge 32 is attached to a portion 30 of the housing 10 which is of constant diameter to better accommodate the hinge 32.

Figure 2:
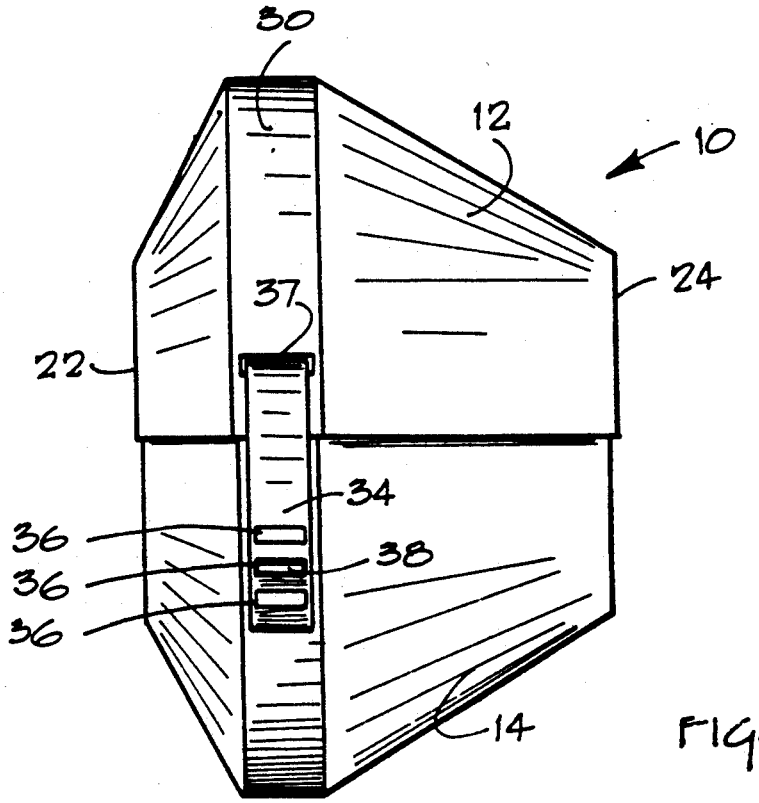
FIG. 2 is a right-side elevational view of a boat propeller cover embodying the invention.
Figure 3:
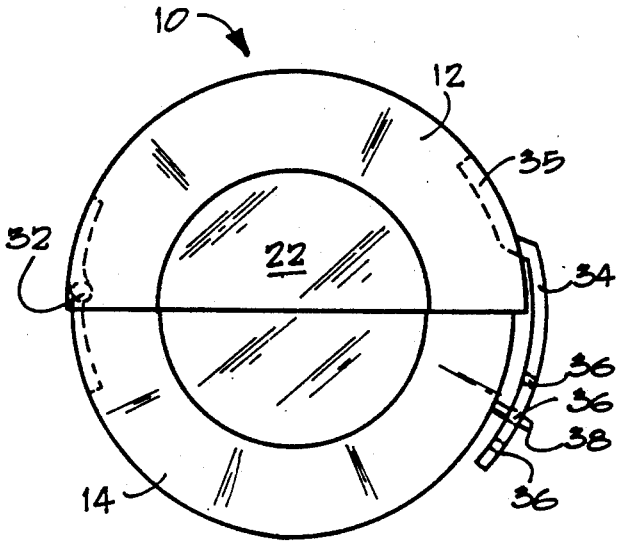
FIG. 3 is a front elevational view of a boat propeller cover embodying the invention.
Figure 4:
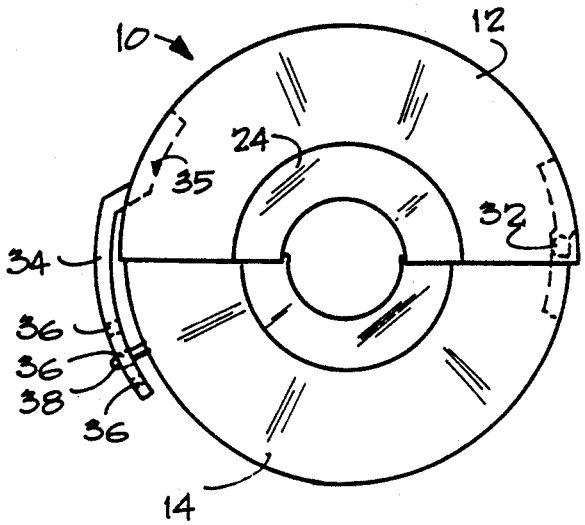
FIG. 4 is a rear elevational view of a boat propeller cover embodying the invention.
Figure 5:
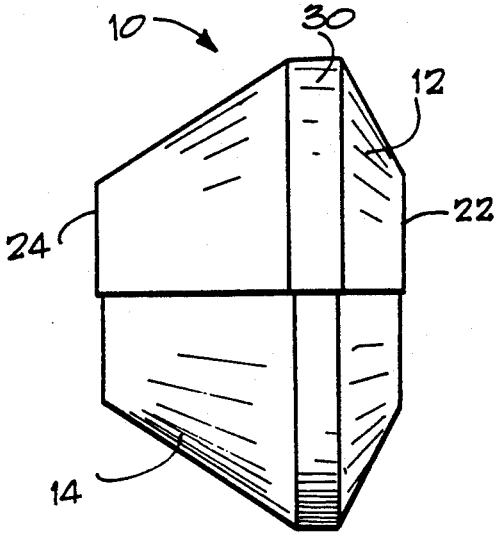
FIG. 5 is a left-side elevational view of a boat propeller cover embodying the invention.

Opposite the hinge is a latch 34. The latch is connected to the inside of the housing 10 by any suitable means. In this embodiment the latch 34 is spot welded to the inside of the housing 10 at latch tabs 35. The latch 34 passes through the housing 10 via opening 37. The connection of the latch 34 to the inside of the housing 10 also enhances resistance to tampering. The latch 34 contains several openings 36 through which padlock eyelet 38 passes. Padlock eyelet 38 is attached through any suitable means to the housing 10 on the housing half not connected to latch 34, and is positioned on portion 30 of the housing 10 which is of constant diameter. As is evident from FIG. 2, the size of the closed housing 10 will depend upon through which opening 36 the padlock eyelet 38 passes.

To use the propeller cover, the two housing halves 12 and 14 are spread apart about hinge 32 and the housing half containing the padlock eyelet 38 is placed underneath the propeller 40 with opening 26 accommodating the propeller shaft 42. The housing half containing the latch 34 is then rotated about hinge 32 over propeller 40 until the latch 34 contacts padlock eyelet 38. The latch 34 is then pulled outward, away from the housing 10, such that the padlock eyelet 38 may enter one of the openings 36 in the latch 34. The size of the propeller 40 will govern which opening 36 is preferred. A typical padlock or combination lock (not shown) may then be placed through the opening in padlock eyelet 38 and locked to prevent unauthorized removal of the propeller 40. It is evident that the propeller 40 is now completely enclosed by housing 10 and protected from damage, and is also less likely to cause injury to people that may unintentionally come into contact with the propeller area of the vessel.

The housing 10 may be made of any durable material, such as steel or aluminum. It may also be made of plastics heavy enough to resist tampering by would be thieves. Various sizes of the device may be produced to accommodate propellers of varying sizes. To accommodate commonly used propellers on outboard motors of moderate size the housing should be between 10 inches and 18 inches in diameter at its widest point, and preferably near 14 inches. It should have a depth of between 5 inches and 10 inches, preferably near 7 inches. The rear of the housing should be truncated to provide a rear surface 24 of between 4 and 8 inches in diameter, preferably near 6 inches. The opening at the rear of the housing should be slightly larger than the propeller shaft 42 which it must accommodate. The required opening will be approximately 4½ inches in diameter for many commonly used propellers and motors.

What I claim is:

1. A boat propeller cover comprising;

a housing of sufficient dimension to enclose a boat propeller and a shaft, said housing being formed generally in the shape of a truncated cone, and being divided into two approximately equal portions along a plane containing the centerline axis of said truncated cone, and containing an opening in the truncated face of said housing of sufficient dimension to accommodate the boat propeller shaft;

connecting means to connect said two approximately equal portions of said housing to each other; and latching means whereby said two approximately equal portions of said housing may be locked together.

2. The device described in claim 1 wherein said connecting means comprises a hinge.

3. The device described in claim 2 wherein said hinge is connected to said two approximately equal portions of said housing on the inside of said housing.

4. The device described in claim 1 wherein said latching means comprises;

a latch containing at least one opening, said latch being connected to one of said two approximately equal portions of said housing, and an eyelet containing an opening suitable to accommodate a locking device, connected to the approximately equal portion of said housing not connected to said latch, whereby said eyelet passes through one of said latch openings upon the fitting together of said two approximately equal portions of said housing.

5. The device described in claim 4 wherein said latch is connected to the inside of said one equal portion of said housing and extends outwardly through an opening in said approximately equal portion of said housing to which said latch is connected.

6. A boat propeller cover comprising;

a housing of sufficient dimension to enclose a boat propeller and a shaft said housing being formed generally in the shape of a truncated cone, and being divided into two approximately equal portions along a plane containing the centerline axis of said truncated cone, and containing an opening in the truncated face of said housing of sufficient dimension to accommodate the boat propeller shaft;

connecting means to connect said two approximately equal portions of said housing to each other; and latching means comprising;

a latch having two ends, wherein one end of said latch is located inside of one of said two approximately equal portions of said housing, said latch extending outwardly through an opening in said approximately equal portion of said housing inside of which said one end of said latch is located, and wherein the other end of said latch contains at least one opening, and;

an eyelet containing an opening suitable to accommodate a locking device, said eyelet being connected to the approximately equal portion of said housing not containing said latch, whereby said eyelet passes through an opening of said latch upon the fitting together of said two approximately equal portions of said housing, and said two approximately equal portions of said housing may be locked together.

7. The device described in claim 6 wherein said connecting means comprises a hinge.

8. The device described in claim 7 wherein said hinge is connected to said two approximately equal portions of said housing on the inside of said housing.

9. A boat propeller cover comprising;

a housing of sufficient dimension to enclose a boat propeller and a shaft said housing being divided into two approximately equal portions and containing an opening at one end of said housing of sufficient dimension to accommodate the boat propeller shaft;

connecting means to connect said two approximately equal portions of said housing to each other; and latching means comprising;

a latch having two ends, wherein one end of said latch is located inside of one of said two approximately equal portions of said housing, said latch extending outwardly through an opening in said approximately equal portion of said housing inside of which said one end of said latch is located, and wherein the other end of said latch contains at least one opening, and;

an eyelet containing an opening suitable to accommodate a locking device, said eyelet being connected to the approximately equal portion of said housing not containing said latch, whereby said eyelet passes through an opening of said latch upon the fitting together of said two approximately equal portions of said housing, and said two approximately equal portions of said housing may be locked together.

10. The device described in claim 9 wherein said connecting means comprises a hinge.

11. The device described in claim 10 wherein said hinge is connected to said two approximately equal portions of said housing on the inside of said housing.

* * * * *